US012193503B2

(12) United States Patent
Courbat et al.

(10) Patent No.: US 12,193,503 B2
(45) Date of Patent: Jan. 14, 2025

(54) HEATER ASSEMBLY FOR AN AEROSOL-GENERATING SYSTEM

(71) Applicant: PHILIP MORRIS PRODUCTS S.A., Neuchatel (CH)

(72) Inventors: Jerome Christian Courbat, Neuchatel (CH); Irene Taurino, Lausanne (CH); Ihar Zinovik, Peseaux (CH)

(73) Assignee: Philip Morris Products S.A., Neuchatel (CH)

( * ) Notice: Subject to any disclaimer, the term of this patent is extended or adjusted under 35 U.S.C. 154(b) by 957 days.

(21) Appl. No.: 17/278,772

(22) PCT Filed: Sep. 27, 2019

(86) PCT No.: PCT/EP2019/076324
§ 371 (c)(1),
(2) Date: Mar. 23, 2021

(87) PCT Pub. No.: WO2020/065077
PCT Pub. Date: Apr. 2, 2020

(65) Prior Publication Data

US 2022/0039470 A1 Feb. 10, 2022

(30) Foreign Application Priority Data

Sep. 28, 2018 (EP) ..... 18197741

(51) Int. Cl.
*A24F 47/00* (2020.01)
*A24F 40/10* (2020.01)
(Continued)

(52) U.S. Cl.
CPC ..... *A24F 40/46* (2020.01); *A24F 40/10* (2020.01); *A24F 40/42* (2020.01); *A24F 40/48* (2020.01)

(58) Field of Classification Search
CPC ..... A24F 40/46; A24F 40/10; A24F 40/42; A24F 40/48; A24F 40/44; H05B 3/12; H05B 2203/02
See application file for complete search history.

(56) References Cited

U.S. PATENT DOCUMENTS 5,573,692 A 11/1996 Das
10,729,181 B2 8/2020 Zinovik
(Continued)

FOREIGN PATENT DOCUMENTS

CN 105559147 5/2016
CN 108451045 8/2018
(Continued)

OTHER PUBLICATIONS

Search Report and Written Opinion for PCT/EP2019/076324 dated Dec. 5, 2019 (9 pages).
(Continued)

*Primary Examiner* — Abdullah A Riyami
*Assistant Examiner* — Nelson R. Burgos-Guntin
(74) *Attorney, Agent, or Firm* — Mueting Raasch Group

(57) ABSTRACT

A heater assembly (300) for an aerosol-generating system, the heater assembly comprising: a fluid permeable heater (322) for heating a liquid aerosol-forming substrate to form an aerosol; a porous member (324) for conveying liquid aerosol-forming substrate to the fluid permeable heater, wherein the fluid permeable heater is deposited on to a porous outer surface (324*a*) of the porous member, the fluid permeable heater comprising: a first layer (326) of deposited electrically conductive material; a second layer (328) of deposited electrically conductive material, wherein the electrical conductivity of the second layer is greater than the electrical conductivity of the first layer such that the second
(Continued)

layer modifies the electrical resistance of the fluid permeable heater to a required resistance.

15 Claims, 4 Drawing Sheets

(51) Int. Cl.

| | |
|---|---|
| ***A24F 40/42*** | (2020.01) |
| ***A24F 40/46*** | (2020.01) |
| ***A24F 40/48*** | (2020.01) |

(56) References Cited

U.S. PATENT DOCUMENTS

| | | | | |
|---|---|---|---|---|
| 2014/0060554 | A1 | 3/2014 | Collett | |
| 2014/0261495 | A1* | 9/2014 | Novak, III | H05B 3/46 392/386 |
| 2017/0340003 | A1* | 11/2017 | Batista | A24F 40/46 |
| 2017/0340011 | A1* | 11/2017 | Batista | A24F 40/46 |
| 2017/0340014 | A1* | 11/2017 | Batista | A24F 40/485 |
| 2017/0347706 | A1* | 12/2017 | Aoun | A61M 11/045 |
| 2017/0347713 | A1* | 12/2017 | Robinson | B32B 15/18 |
| 2017/0360092 | A1* | 12/2017 | Althorpe | A61M 15/06 |
| 2017/0360095 | A1* | 12/2017 | Batista | A61M 15/0091 |
| 2017/0360099 | A1* | 12/2017 | Duc | H05B 1/0227 |
| 2017/0367407 | A1* | 12/2017 | Althorpe | A24F 40/40 |
| 2017/0367411 | A1* | 12/2017 | Duc | A24F 40/44 |

FOREIGN PATENT DOCUMENTS

| | | |
|---|---|---|
| JP | 2018-523990 | 8/2018 |
| WO | WO 2017/005471 | 1/2017 |
| WO | WO 2017/066955 | 4/2017 |

OTHER PUBLICATIONS

Extended European Search Report for Application No. 18197741.4 dated Mar. 14, 2019 (5 pages).

Office Action issued in Japan for Application No. 2021-516415 dated Aug. 24, 2023 (10 pages). English translation included.

* cited by examiner

HEATER ASSEMBLY FOR AN AEROSOL-GENERATING SYSTEM

This application is a U.S. National Stage Application of International Application No. PCT/EP2019/076324 filed Sep. 27, 2019, which was published in English on Apr. 2, 2020 as International Publication No. WO 2020/065077 A1. International Application No. PCT/EP2019/076324 claims priority to European Application No. 18197741.4 filed Sep. 28, 2018.

The present invention relates to aerosol-generating systems and to heater assemblies for aerosol-generating systems, the heater assemblies comprising an electric heater that is suitable for vaporising an aerosol-forming substrate. In particular, the invention relates to handheld electrically operated aerosol-generating systems. Aspects of the invention relate to heater assemblies for an aerosol-generating system, cartridges for an aerosol-generating system and to methods for manufacturing the heater assemblies.

Handheld electrically operated smoking systems typically comprise a device portion comprising a battery and control electronics, and a cartridge portion comprising a supply of aerosol-forming substrate and an electrically operated vaporiser. A cartridge comprising both a supply of aerosol-forming substrate and a vaporiser is sometimes referred to as a "cartomiser" or "atomizer". The vaporiser is typically a heater assembly and the cartridge portion may also comprise a mouthpiece, on which the user draws in use to draw aerosol into their mouth.

In some known examples, the aerosol-forming substrate is a liquid aerosol-forming substrate and the vaporiser comprises a coil of heater wire wound around an elongate wick soaked in liquid aerosol-forming substrate. Electric current passing through the wire causes resistive heating of the wire which vaporises the liquid in the wick. The wick is typically held within an airflow path so that air is drawn past the wick and entrains the vapour. The vapour subsequently cools to form an aerosol.

This type of system can be effective at producing aerosol but it can also be challenging to manufacture in a low cost and repeatable way. Furthermore, the wick and coil assembly, together with associated electrical connections, can be fragile and difficult to handle, particularly on an automated production line.

It would be desirable to provide a heater assembly for an aerosol-generating system that has improved aerosol characteristics. It would be further desirable to provide a more robust heater assembly for an aerosol-generating system, which is easier or less expensive to manufacture. In addition, it would be desirable to provide a cartridge for an aerosol-generating system that has improved aerosol characteristics.

According to a first aspect of the present invention, there is provided a heater assembly for an aerosol-generating system, the heater assembly comprising: a fluid permeable heater for heating a liquid aerosol-forming substrate to form an aerosol; a porous member for conveying liquid aerosol-forming substrate to the fluid permeable heater, wherein the fluid permeable heater is deposited onto a porous outer surface of the porous member, the fluid permeable heater comprising: a first layer of deposited electrically conductive material; a second layer of deposited electrically conductive material, wherein the electrical conductivity of the second layer is greater than the electrical conductivity of the first layer such that the second layer modifies the electrical resistance of the fluid permeable heater to a required resistance.

The fluid permeable heater may be an electric heater. The fluid permeable heater may be heated by resistive heating, i.e. by passing an electric current through the heater such that electric energy is converted to heat through resistive losses in the heater. Alternatively, the fluid permeable heater may be heated by induction, i.e. by placing the heater inside a time-varying magnetic field, for example, a high-frequency alternating magnetic field, such that eddy currents are induced in the heater, resulting in resistive losses and causing heating of the heater. Therefore, by modifying the electrical resistance of the fluid permeable heater, the heating characteristics of the heater can be altered.

Advantageously, the provision of a multi-layer heater, in particular a heater comprising a second layer which is more electrically conductive than the first layer, allows the electrical resistance of the heater to be modified to achieve a required resistance. This means that it is not necessary to achieve the required resistance through provision of a single layer alone and finer adjustments to the resistance can be made through the provision of the second layer. For example, this would allow the first layer to be formed from a material which may not quite provide the required resistance but which is cheaper or easier to manufacture and the resistance to be modified to the required value by using a second layer formed from a relatively small amount of a more expensive material.

By depositing the fluid permeable heater onto a porous outer surface of the porous member, contact between the heater and the porous member may be improved. For example by compensating for surface roughness or unevenness on the outer surface of the porous member. This may enable a reduction in the number or severity of "hot spots" (localised areas of increased heating) on the outer surface of the porous member, which may otherwise occur if the heater is not fully in contact with the porous member and may, therefore, result in improved aerosol characteristics. Improved contact between the heater and the porous member may also allow improved delivery of the liquid aerosol-forming substrate to the heater.

Furthermore, by depositing the fluid permeable heater onto a porous outer surface of the porous member, the porous member provides structural support for the heater and a thin heater can be used. This reduces mechanical and thermal stresses between the heater and the porous member which increases the lifetime of the heater.

A further advantage is that the heater can be deposited over substantially all of an outer surface of the porous member, for example, one end of the porous member, which allows for a larger heater surface and more efficient use of the outer surface of the porous member.

As used herein, the term "fluid permeable" with respect to the heater means that the heater allows a fluid, for example, a gas or a liquid, to pass through it. For example, it allows liquid aerosol-forming substrate to pass into the pores in the heater to be vaporised and it allows vaporised aerosol-forming substrate formed at the heater to leave the pores in the heater.

As used herein, the term "porous" means formed from a material that is permeable to the liquid aerosol-forming substrate and allows the liquid aerosol-forming substrate to migrate through it.

As used herein, the term "porous member" refers to a component of the heater assembly that is able to convey the liquid aerosol-forming substrate to the heater by capillary action.

As used herein, the term "electrically conductive material" denotes a material having a resistivity of $1\times10^{-2}$ Ωm, or less.

As used herein, the term "deposited" means applied as a coating on the outer surface of the porous member, for example in the form of a liquid, plasma or vapour which subsequently condenses or aggregates to form the first or second layer of the heater, rather than simply being laid on the porous member as a solid, pre-formed component.

The first layer may be formed from any suitable electrically conductive material. In certain preferred embodiments, the electrically conductive material comprises one or more of a metal, an electrically conductive polymer and an electrically conductive ceramic.

Suitable electrically conductive metals for the first layer include tungsten, tantalum, steel, platinum, molybdenum, titanium, cobalt and/or alloys thereof. Other suitable materials for the first layer include electro-conductive polysilicon such as doped polysilicon, or NiCr alloy.

Suitable electrically conductive polymers for the first layer include PEDOT (poly(3,4-ethylenedioxythiophene)), PSS (poly(p-phenylene sulfide)), PEDOT:PSS (mixture of both PEDOT and PSS), PANI (polyanilines), PPY (poly (pyrrole)s), PPV (Poly(p-phenylene vinylene)), or any combination thereof.

Suitable electrically conductive ceramics for the first layer include ITO (Indium Tin Oxide), SLT (lanthanum-doped strontium titanate), SYT (yttrium-doped strontium titanate), aluminium oxide, or any combination thereof.

The first layer may be deposited directly on the porous outer surface of the porous member. This assists in adhering the first layer to the porous member, which reduces the risk of a loss of contact between the heater and the porous member caused by deformation of the heater, for example during assembly or due to thermal stresses induced during use.

Alternatively, the fluid permeable heater further may comprise a third layer arranged between the porous outer surface of the porous member and the first layer. The third layer may be deposited directly on the porous outer surface of the porous member and may act as an adhesion layer to improve the adhesion between the first layer and the porous outer surface of the porous member. The third layer may comprise a material selected from one or more of Tantalum, Titanium and Chromium. These have been found to be suitable materials for improving the adhesion of the first layer and the porous outer surface of the porous member.

Depending on the layer in contact with the porous outer surface of the porous member, the first or third layer may be at least partially diffused into the porous outer surface.

As used herein, the term "diffused into the porous outer surface" means that the first or third layer is embedded in, or intermingled with, the material of the porous outer surface at the interface between the first or third layer and the porous member, for example by extending into the pores of the porous outer surface and by partly moving into the surface vicinity of the porous member.

With this arrangement, contact between the heater and the porous member may be further improved, leading to a further reduction in the number or severity of "hot spots" on the porous outer surface of the porous member and improved aerosol characteristics. Further, by extending into the porous outer surface of the porous member, the area of contact between the heater and the porous member is increased. This may lead to a further improvement in the delivery of liquid aerosol-forming substrate to the heater by the porous member and to improved heating of the liquid aerosol-forming substrate by the heater. It may also further increase adhesion between the fluid permeable heater and the porous member, further reducing the risk of a loss of contact between the heater and the porous member caused by deformation of the heater, for example during assembly or due to thermal stresses induced during use.

The second layer may be deposited on or over the first layer. Alternatively, the first layer may be deposited on or over the second layer. These arrangements allow the resistance of the heater to be modified to the required value by using a second layer in electrical contact with the first layer. The second layer may be formed from a relatively small amount of a more expensive material compared to the first layer. The second layer may be formed from any suitable electrically conductive material having a higher electrical conductivity than the first layer. In certain embodiments, the second layer may preferably comprise a material having a resistivity of less than $5\times10^{-8}$ Ωm, more preferably less than $4\times10^{-8}$ Ωm and yet more preferably less than $3\times10^{-8}$ Ωm. The second layer may comprise a material selected from one or more of gold, silver, aluminium or copper, which materials have been found to have suitable properties for modifying the electrical resistance of the fluid permeable heater. The skilled person will appreciate that other materials having suitable properties may also be used.

The thickness of the first layer may be an order of magnitude greater than the thickness of the second layer and, optionally, the thickness of the first layer may be two or more orders of magnitude greater than the thickness of the second layer. The ratio of the thickness of the first layer to the thickness of the second layer may be 1000:1 or less, more particularly 500:1 or less, and yet more particularly 250:1 or less. The ratio of the thickness of the first layer to the thickness of the second layer may be between 2.5:1 and 1000:1, more particularly between 2.5:1 and 500:1, and yet more particularly between 2.5:1 and 250:1. The thickness of the first layer may be 10 μm or less, more particularly 2.5 μm or less, more particularly less than 0.5 μm, and yet more particularly 0.1 μm or less. The thickness of the first layer may be between 5 nm and 10 μm, more particularly between 50 nm and 2.5 μm, more particularly between 50 nm and 0.5 μm, and yet more particularly between 50 nm and 0.1 μm. These ranges of thicknesses have been found to provide sufficient electrical conductivity to the heater to assist in reducing the number or severity of "hot spots", whilst being sufficiently thin to reduce the likelihood of filling or blocking the pores of the porous outer surface of the porous member such that the porous outer surface remains porous. The thickness of the first layer is dependent on the grain and pore size of the porous member. Porous materials with smaller grain and pore size will require the selection of thinner thicknesses from the thickness range mentioned above.

The thickness of the second layer may be between 10 and 20 nm. This range of thicknesses has been found to be sufficient for modifying the electrical resistance of the heater. The thickness of the second layer is relatively small compared to the first layer and therefore the second layer need only comprise a relatively small amount of electrically conductive material. Given that the second layer does not significantly increase the thickness of the fluid permeable heater, the risk of filling or blocking the pores of the porous outer surface of the porous member is not significantly increased such that the porous outer surface remains porous.

The thickness of the third layer may be between 10 and 20 nm. This range of thicknesses has been found to be sufficient for improving the adhesion between the first layer and the porous outer surface of the porous member. Again, the third layer does not significantly increase the thickness of the fluid permeable heater and therefore the risk of filling or blocking the pores of the porous outer surface of the porous member is not significantly increased such that the porous outer surface remains porous.

The second layer may modify the electrical resistance of the fluid permeable heater to between 0.3 and 4 Ohms, more particularly between 0.5 and 1.5 Ohms and yet more particularly 1 Ohm. It is generally advantageous to have a low overall resistance for the fluid permeable heater if the heater assembly is to be used with an aerosol-generating system powered by a battery. A low resistance, high current system allows for the delivery of high power to the fluid permeable heater. This allows the heater to be heated to a desired temperature quickly.

The first, second and third layers may be deposited onto the porous outer surface of the porous member in any suitable manner. For example, one or more of the first, second and third layers may be deposited onto the porous outer surface by one or more vacuum deposition processes, such as evaporation deposition, sputtering, physical vapour deposition (PVD) or plasma-enhanced chemical vapour deposition (PECVD).

In some embodiments, the first, second and third layers may comprise a printable electrically conductive material printed on the porous outer surface of the porous member. In such embodiments, any suitable known printing technique may be used. For example, one or more of aerosol jet printing, stamping, pad printing, screen-printing, gravure printing, flex-printing and inkjet printing.

The printable electrically conductive material may comprise metal particles suspended in an adhesive agent. The printable electrically conductive material may further comprise one or more additives selected from a group consisting of: solvents; curing agents; adhesion promoters; surfactants; viscosity reduction agents; and aggregation inhibitors. Such additives may be used, for example, to aid deposition of the electrically conductive material on the porous outer surface of the porous member, to increase the amount by which the electrically conductive material diffuses into the porous outer surface of the porous member, to reduce the time required for the electrically conductive material to set, to increase the level of adhesion between the electrically conductive material and the porous member, or to reduce the amount of aggregation of suspended particles, such as metal particles or powder, in the electrically conductive material prior to application onto the porous outer surface of the porous member.

The heater assembly may comprise first and second electrically conductive contact pads or portions for connecting the fluid permeable heater to a power supply. In some embodiments, the contact portions may be fixed directly to the fluid permeable heater such that they are in electrical contact with the fluid permeable heater. In such embodiments, the first and second electrically conductive contact portions may be formed from an electrically conductive material deposited directly onto the porous outer surface of the porous member or directly on to the fluid permeable heater.

In other embodiments, the electrically conductive contact portions may be integral with the fluid permeable heater. For example, the second layer of the fluid permeable heater may comprise the contact portions, i.e. the second layer may be deposited specifically to form the contact portions or the second layer may have an increased thickness in the region of the contact portions. The provision of electrically conductive contact portions that are integral with the fluid permeable heater allows for reliable and simple connection of the heater to a power supply.

The electrical resistance of the fluid permeable heater is preferably at least an order of magnitude, and more preferably at least two orders of magnitude, greater than the electrical resistance of the contact portions. This ensures that, when an electric current is supplied to the heater assembly, the heat generated is localised to the fluid permeable heater. In embodiments in which the electrically conductive contact portions are integral with the fluid permeable heater, this may be achieved by forming the electrically conductive contact portions from the second layer of the fluid permeable heater or by making the second layer thicker in the region of the contact portions in order to reduce the electrical resistance of the contact portions relative to the heat generation part of the fluid permeable heater. Such arrangements may also help reduce contact resistances between the contact portions and the fluid permeable heater, which is also desirable in order to minimize power losses.

The porous member may comprise a capillary material having a fibrous or porous structure which forms a plurality of small bores or channels, through which the liquid aerosol-forming substrate can be conveyed or transported by capillary action. The porous member may comprise a bundle of capillaries, for example, a plurality of fibres or threads or other fine bore tubes. The fibres or threads may be generally aligned to convey liquid aerosol-forming substrate towards the transport material. Alternatively, the porous member may have a sponge-like or foam-like structure. The porous member may comprise any suitable material or combination of materials. Examples of suitable materials include sponge or foam materials, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic.

In certain preferred embodiments, the porous member may comprise a material selected from one or more of porous glass, quartz, plastics or ceramic materials with porosity 40% or higher. Particles or grains of the aforementioned materials may be sintered to provide a suitable porosity. Suitable ceramic materials include, for example, $SiO_2$, AlN or $Al_2O_3$ and. suitable plastics include, for example, polyimide, polyamide or polyether ether ketone (PEEK). In other preferred embodiments, the porous member may comprise glass fibres, cotton or Kevlar.

The porous member may have any suitable capillarity and porosity so as to be used with different liquid physical properties. The liquid aerosol-forming substrate has physical properties, including but not limited to viscosity, surface tension, density, thermal conductivity, boiling point and vapour pressure, which allow the liquid to be transported through the capillary device by capillary action.

The heater assembly may further comprise a retention material arranged in contact with the porous member for retaining and conveying liquid aerosol-generating substrate to the porous member. The retention material may also comprise a capillary material having a fibrous or porous structure which forms a plurality of small bores or micro-channels, through which the liquid aerosol-forming substrate can be transported by capillary action. The retention material may comprise a bundle of capillaries, for example, a plurality of fibres or threads or other fine bore tubes. The fibres or threads may be generally aligned to convey liquid aerosol-forming substrate towards the porous member.

Alternatively, the retention material may comprise sponge-like or foam-like material. The retention material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. In certain preferred embodiments, the retention material may comprise high density polyethylene (HDPE) or polyethylene terephthalate (PET). The retention material may have a superior wicking performance compared to the porous member such that it retains more liquid per unit volume than the porous member. Furthermore, the porous member may have a higher thermal decomposition temperature than the retention material.

The retention material may be spaced apart from the fluid permeable heater by the porous member and the porous member may have a higher thermal decomposition temperature than the retention material. This arrangement means that porous member effectively acts as a spacer separating the fluid permeable heater from the retention material so that the retention material is not exposed to temperatures above its thermal decomposition temperature. In some embodiments, the thermal decomposition temperature of the porous member is at least 160 degrees Celsius, and preferably at least 250 degrees Celsius.

The retention material may advantageously occupy a greater volume than the porous member and may hold more liquid aerosol-forming substrate than the porous member. The retention material may have superior wicking performance compared to the porous member. The retention material may comprise a less expensive material or have a higher filling capability than the porous member.

The porous member may have a thickness of between 2 and 6 mm inclusive.

In some embodiments the fluid permeable heater may be non-patterned, i.e. the heater is deposited as a continuous layer on the porous member without having a pattern. The fluid permeable heater may be deposited over substantially all of an outer surface of the porous member. The fluid permeable heater may be deposited over substantially all of a porous first end of the porous member.

Alternatively, the fluid permeable heater may comprise an array of electrically conductive filaments extending along the length of the heater, a plurality of apertures being defined by interstices between the electrically conductive filaments. In such embodiments, the size of the plurality of apertures may be varied by increasing or decreasing the size of the interstices between adjacent filaments. This may be achieved by varying the width of the electrically conductive filaments, or by varying the interval between adjacent filaments, or by varying both the width of the electrically conductive filaments and the interval between adjacent filaments.

As used herein, the term "filament" refers to an electrical path arranged between two electrical contacts. In preferred embodiments, the filaments have a substantially flat cross-section. As used herein, "substantially flat" preferably means formed in a single plane and for example not wrapped around or other conformed to fit a curved or other non-planar shape. A flat heater can be easily handled during manufacture and provides for a robust construction. A filament may be arranged in a straight or curved manner.

The liquid aerosol-forming substrate is a liquid substrate capable of releasing volatile compounds that can form an aerosol. The volatile compounds may be released by heating the aerosol forming substrate.

The liquid aerosol-forming substrate may comprise plant-based material. The liquid aerosol-forming substrate may comprise tobacco. The liquid aerosol-forming substrate may comprise a tobacco-containing material containing volatile tobacco flavour compounds, which are released from the aerosol-forming substrate upon heating. The liquid aerosol-forming substrate may alternatively comprise a non-tobacco-containing material. The liquid aerosol-forming substrate may comprise homogenised plant-based material. The liquid aerosol-forming substrate may comprise homogenised tobacco material. The liquid aerosol-forming substrate may comprise at least one aerosol-former. An aerosol-former is any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The liquid aerosol-forming substrate may comprise other additives and ingredients, such as flavourants.

According to a second aspect of the present invention, there is provided a cartridge for use in an aerosol-generating system, the cartridge comprising a liquid storage portion for holding a liquid aerosol-forming substrate; and any of the heater assembly embodiments described above.

The fluid permeable heater may be deposited on to a porous first end of the porous member and wherein a second end of the porous member extends into the liquid storage portion for contact with the liquid aerosol-forming substrate therein.

The liquid storage portion may include a housing for holding the liquid aerosol-forming substrate. The housing may have an opening for allowing vaporised aerosol-forming substrate to escape, wherein the porous member is arranged such that the fluid permeable heater extends across the opening. The opening may be of any appropriate shape. For example the opening may have a circular, square or rectangular shape. The area of the opening may be small, preferably less than or equal to about 25 millimetres squared. The liquid storage portion may comprise a retention material as described herein.

In some embodiments, the fluid permeable heater is arranged in such a way that the physical contact area with the liquid storage portion is reduced compared with a case in which the heater is in contact around the whole of the periphery of the liquid storage portion. The fluid permeable heater preferably does not directly contact the perimeter of the liquid storage portion. This may be achieved by providing a spacing between the outer edge of the fluid permeable heater and the periphery of the opening, which spacing can be dimensioned such that thermal contact is significantly reduced. The spacing between the heater and the opening periphery may be between 25 microns and 40 microns. In this way thermal contact to the liquid storage portion is reduced and less heat is transferred to the liquid storage portion, thus increasing efficiency of heating and therefore aerosol generation.

In alternative embodiments, the heater assembly may be provided as an integral part of an aerosol-generating system, rather than forming part of a cartridge for use in the aerosol-generating system.

According to a third aspect of the present invention, there is provided an aerosol-generating system comprising: an aerosol-generating device; and a cartridge as described above, wherein the cartridge is removably coupled to the aerosol-generating device and the aerosol-generating device includes a power supply for the heater assembly.

As used herein, the cartridge being "removably coupled" to the device means that the cartridge and device can be coupled and uncoupled from one another without damaging either the device or the cartridge.

The cartridge can be exchanged after consumption. As the cartridge holds the aerosol forming substrate and the fluid permeable heater, the heater is also exchanged regularly such that the consistent vaporization conditions are maintained even after longer use of the main unit.

The aerosol-generating system may further comprise electrical circuitry connected to the fluid permeable heater and to an electrical power supply, the electric circuitry being configured to monitor an electrical resistance of the fluid permeable heater and to control the supply of power from the electrical power supply to the heater based on the monitored electrical resistance. By monitoring the temperature of the heater, the system can prevent over- or under-heating of the heater and ensure that consistent vaporization conditions are provided.

The electric circuitry may comprise a microprocessor, which may be a programmable microprocessor, a microcontroller, or an application specific integrated chip (ASIC) or other electronic circuitry capable of providing control. The electric circuitry may comprise further electronic components. The electric circuitry may be configured to regulate a supply of power to the heater. Power may be supplied to the fluid permeable heater continuously following activation of the system or may be supplied intermittently, such as on a puff by puff basis. The power may be supplied to the heater in the form of pulses of electrical current.

The power supply may be a battery, such as a lithium iron phosphate battery, within the device. As an alternative, the power supply may be another form of charge storage device such as a capacitor. The power supply may require recharging and may have a capacity that allows for the storage of enough energy for one or more smoking experiences. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater.

The liquid storage portion may be positioned on a first side of the fluid permeable heater and an airflow channel positioned on an opposite side of the heater to the storage portion, such that air flow past the heater entrains vaporised aerosol-forming substrate.

The system may be a handheld aerosol-generating system. The aerosol-generating system may have a size comparable to a conventional cigar or cigarette. The smoking system may have a total length between approximately 30 millimetres and approximately 150 millimetres. The smoking system may have an external diameter between approximately 5 millimetres and approximately 30 millimetres.

According to a fourth aspect of the present invention, there is provided a method of manufacturing a heater assembly for an aerosol-generating system, the method comprising: providing a porous member; depositing a fluid permeable heater onto a porous outer surface of the porous member, the fluid permeable heater comprising: a first layer of deposited electrically conductive material; a second layer of deposited electrically conductive material; wherein the electrical conductivity of the second layer is greater than the electrical conductivity of the first layer such that the second layer modifies the electrical resistance of the fluid permeable heater to a required resistance.

The method may further comprise providing the fluid permeable heater with a third layer, wherein the third layer is arrange between the porous out surface of the porous member and the first layer.

The first, second and third layers may be deposited onto the porous outer surface of the porous member in any suitable manner. For example, one or more of the first, second and third layers may be deposited onto the porous outer surface by one or more vacuum deposition processes, such as evaporation deposition, sputtering, physical vapour deposition (PVD) or plasma-enhanced chemical vapour deposition (PECVD).

Where one or more of the first, second or third layers comprises a printable electrically conductive material, the layers may be printed on the porous outer surface of the porous member using any suitable known printing technique. For example, one or more of aerosol jet printing, stamping, pad printing, screen-printing, gravure printing, flex-printing and inkjet printing. Such printing processes may be particularly applicable for high speed production processes.

Having been printed on the porous outer surface of the porous member, the printed electrically conductive material of one or more of the first, second and third layers may be cured in any suitable known manner to form the fluid permeable heater. For example, the printed electrically conductive material may be cured by exposure to heat or to ultraviolet light. Alternatively, or in addition, the printed electrically conductive material may be cured by sintering or by initiating a chemical reaction.

Features described in relation to one or more aspects may equally be applied to other aspects of the invention. In particular, features described in relation to the heater assembly of the first aspect may be equally applied to the cartridge of the second aspect, and vice versa, and features described in relation to the heater assembly of the first aspect or the cartridge of the second aspect may equally apply to the aerosol-generating system of the third aspect or the method of manufacture of the fourth aspect.

Embodiments of the invention will now be described, by way of example only, with reference to the accompanying drawings, in which.

Figure 1:
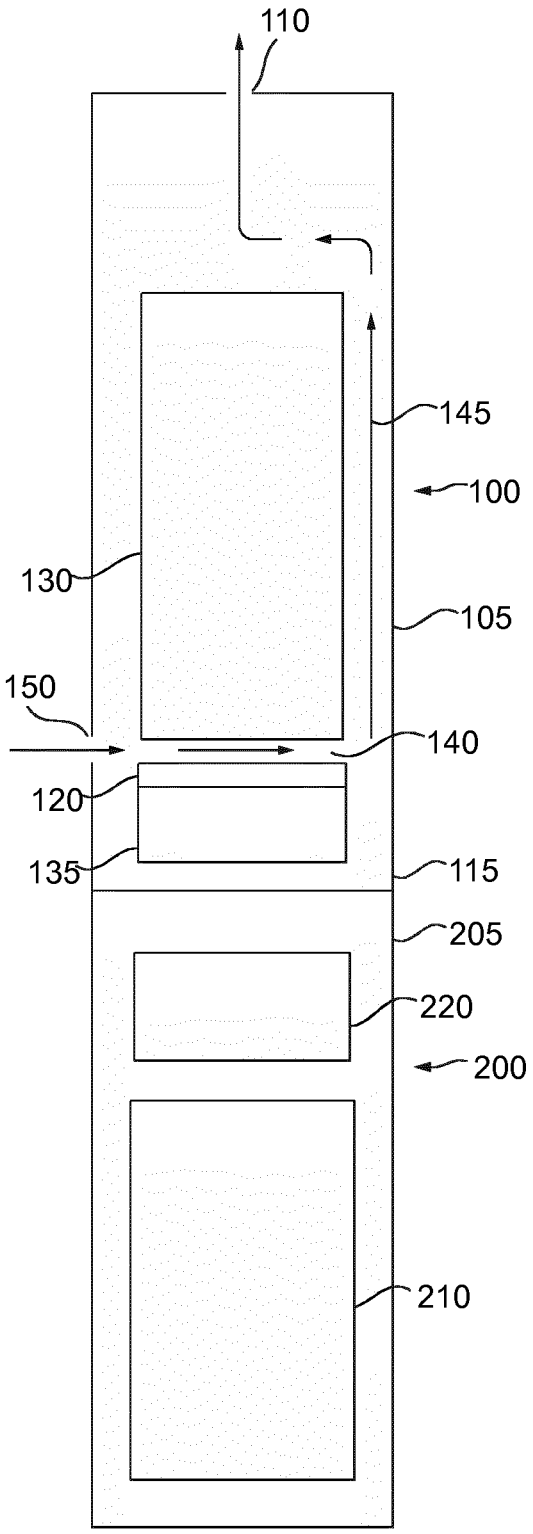
FIG. 1 is a schematic illustration of an aerosol-generating system in accordance with an embodiment of the invention.

Referring to FIG. 1, this shows a schematic illustration of an aerosol-generating system in accordance with an embodiment of the invention. The system comprises two main components, a cartridge 100 and a main body part 200. A connection end 115 of the cartridge 100 is removably connected to a corresponding connection end 205 of the main body part 200. The main body part 200 contains a battery 210, which in this example is a rechargeable lithium ion battery, and control circuitry 220. The aerosol-generating system is portable and has a size comparable to a conventional cigar or cigarette. A mouthpiece is arranged at the end of the cartridge 100 opposite the connection end 115.

The cartridge 100 comprises a housing 105 containing a heater assembly 120 and a liquid storage compartment having a first portion 130 and a second portion 135. A liquid aerosol-forming substrate is held in the liquid storage compartment. Although not illustrated in FIG. 1, the first portion 130 of the liquid storage compartment is connected to the second portion 135 of the liquid storage compartment so that liquid in the first portion 130 can pass to the second portion 135. The heater assembly 120 receives liquid from the second portion 135 of the liquid storage compartment. The heater assembly 120 comprises a fluid permeable heater.

An air flow passage 140, 145 extends through the cartridge 100 from an air inlet 150 formed in a side of the housing 105 past the heater assembly 120 and from the heater assembly 120 to a mouthpiece opening 110 formed in the housing 105 at an end of the cartridge 100 opposite to the connection end 115.

The components of the cartridge 100 are arranged so that the first portion 130 of the liquid storage compartment is between the heater assembly 120 and the mouthpiece opening 110, and the second portion 135 of the liquid storage compartment is positioned on an opposite side of the heater assembly 100 to the mouthpiece opening 110. In other words, the heater assembly 120 lies between the two portions 130, 135 of the liquid storage compartment and receives liquid from the second portion 135. The first portion 130 of liquid storage compartment is closer to the mouthpiece opening 110 than the second portion 135 of the liquid storage compartment. The air flow passage 140, 145 extends past the heater assembly 110 and between the first 130 and second 135 portions of the liquid storage compartment.

The system is configured so that a user can puff or draw on the mouthpiece opening 110 of the cartridge to draw aerosol into their mouth. In operation, when a user puffs on the mouthpiece opening 110, air is drawn through the airflow passage 140, 145 from the air inlet 150, past the heater assembly 120, to the mouthpiece opening 110. The control circuitry 220 controls the supply of electrical power from the battery 210 to the cartridge 100 when the system is activated. This in turn controls the amount and properties of the vapour produced by the heater assembly 120. The control circuitry 220 may include an airflow sensor (not shown) and the control circuitry 220 may supply electrical power to the heater assembly 120 when a user's puff is detected by the airflow sensor. This type of control arrangement is well established in aerosol-generating systems such as inhalers and e-cigarettes. So when a user puffs on the mouthpiece opening 110 of the cartridge 100, the heater assembly 120 is activated and generates a vapour that is entrained in the air flow passing through the air flow passage 140. The vapour cools within the airflow in passage 145 to form an aerosol, which is then drawn into the user's mouth through the mouthpiece opening 110.

In operation, the mouthpiece opening 110 is typically the highest point of the system. The construction of the cartridge 100, and in particular the arrangement of the heater assembly 120 between first and second portions 130, 135 of the liquid storage compartment, is advantageous because it exploits gravity to ensure that the liquid substrate is delivered to the heater assembly 120 even as the liquid storage compartment is becoming empty, but prevents an oversupply of liquid to the heater assembly 120 which might lead to leakage of liquid into the air flow passage 140.

Figure 2:
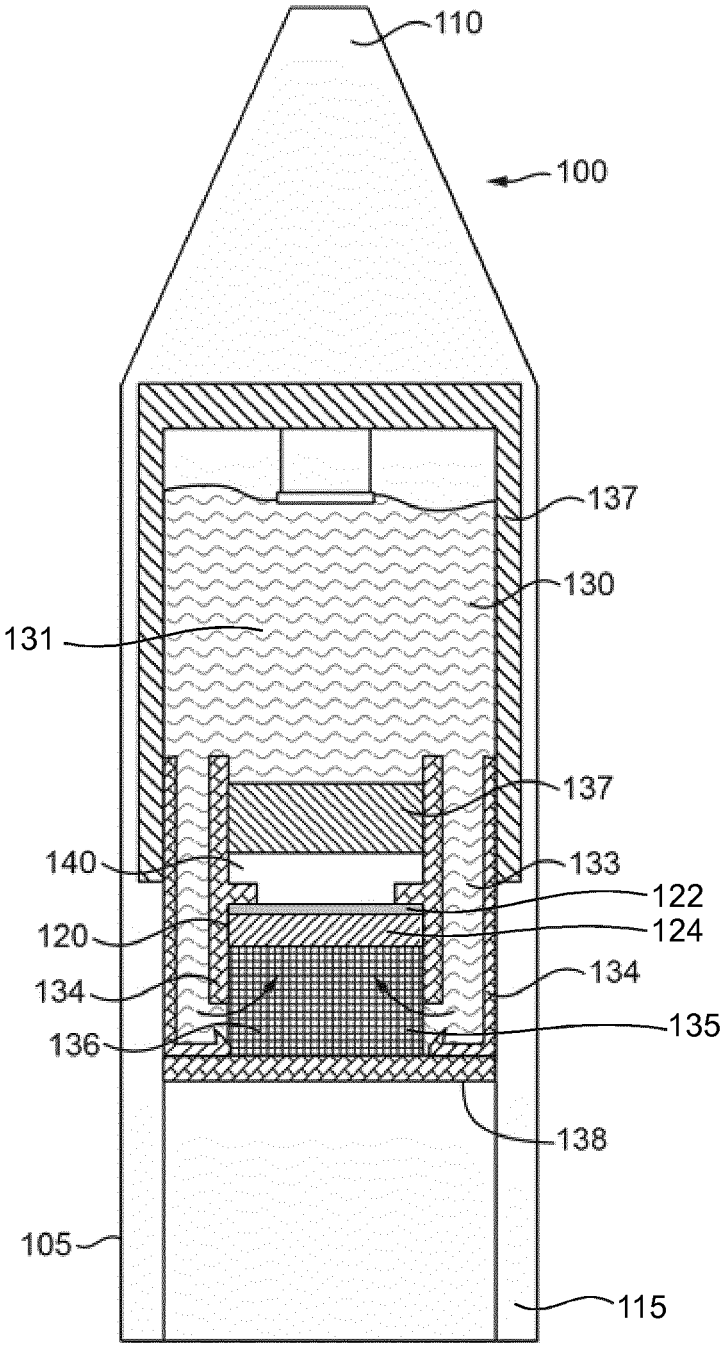
FIG. 2 is a schematic illustration of a cross-section of a cartridge, including a mouthpiece, in accordance with the invention.

FIG. 2 is a schematic cross section of a cartridge 100 in accordance with an embodiment of the invention. Cartridge 100 comprises an external housing 105 having a mouthpiece with a mouthpiece opening 110, and a connection end 115 opposite the mouthpiece. Within the housing 105 is a liquid storage compartment holding a liquid aerosol-forming substrate 131. The liquid storage compartment has a first portion 130 and a second portion 135 and liquid is contained in the liquid storage compartment by three further components, an upper storage compartment housing 137, a heater mount 134 and an end cap 138. A heater assembly 120 comprising a fluid permeable heater 122 and a porous member 124 is held in the heater mount 134. Contact pads (not shown) are provided on opposing sides of the fluid permeable heater 122 to supply electrical power to the fluid permeable heater 122. The heater assembly 120 is closer to the connection end 115 so that electrical connection of the heater assembly 120 to a power supply can be easily and robustly achieved. A retention material 136 is provided in the second portion 135 of the liquid storage compartment and abuts the porous member 124 of the heater assembly 120. The retention material 136 is arranged to transport liquid to the porous member 124 of the heater assembly 120.

The first portion 130 of the liquid storage compartment is larger than the second portion 135 of the storage compartment and occupies a space between the heater assembly 120 and the mouthpiece opening 110 of the cartridge 100. Liquid in the first portion 130 of the storage compartment can travel to the second portion 135 of the liquid storage compartment through liquid channels 133 on either side of the heater assembly 120. Two channels are provided in this example to provide a symmetric structure, although only one channel is necessary. The channels are enclosed liquid flow paths defined between the upper storage compartment housing 137 and the heater mount 134.

The fluid permeable heater 122 is deposited on to a porous outer surface of the porous member 124 and is arranged on a side of the heater assembly 120 facing the first portion 130 of the liquid storage compartment and the mouthpiece opening 110. In particular, the fluid permeable heater 122 is deposited on to a porous first end of the porous member 124. A porous second end of the porous member 124 extends into the second portion 135 of the liquid storage compartment where it contacts the retention material 136 such that the porous member 124 can receive liquid aerosol-forming substrate from the retention material 136. The remainder of the second portion 135 of the liquid storage compartment not occupied by the porous member is occupied by the retention material 136 which is in fluid communication with the liquid aerosol-forming substrate 131 delivered via liquid channels 133.

An airflow passage 140 extends between the first and second portions of the storage compartment. A bottom wall of the airflow passage 140 comprises the fluid permeable heater 122. Side walls of the airflow passage 140 comprise portions of the heater mount 134, and a top wall of the airflow passage comprises a surface of the upper storage compartment housing 137. The air flow passage has a vertical portion (not shown) that extends through the first portion 130 of the liquid storage compartment towards the mouthpiece opening 110.

It will be appreciated that the arrangement of FIG. 2 is only one example of a cartridge for an aerosol-generating system. Other arrangements are possible. For example, the fluid permeable heater, porous member and retention material could be arranged at one end of a cartridge housing, with a liquid storage compartment being arranged at the other.

Figure 3:
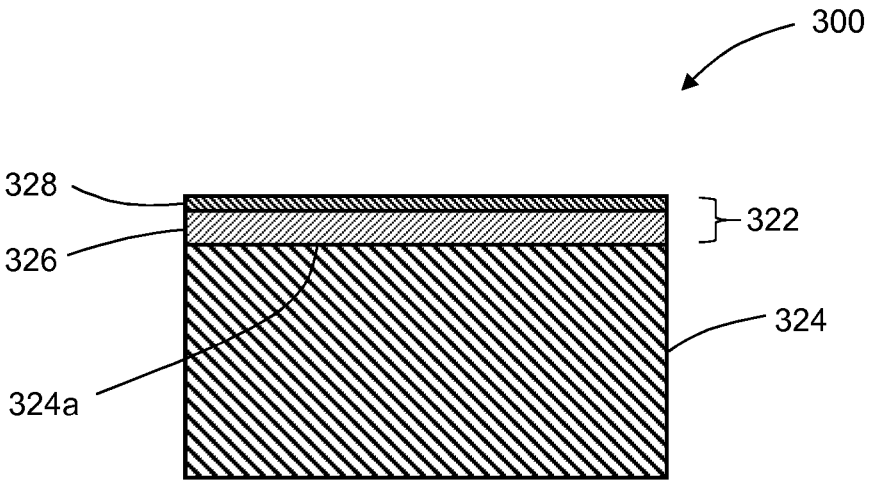
FIG. 3 is a schematic illustration of a cross-section of a heater assembly in accordance with an embodiment of the invention.

FIG. 3 is a schematic illustration of a cross-section of a heater assembly 300 in accordance with an embodiment of the invention. The drawing is not to scale. The heater assembly 300 comprises a porous member 324 and a multi-layer fluid permeable heater 322 deposited on a porous outer surface of a first end 324*a* of the porous member 324. The fluid permeable heater 322 is formed of first 326 and second 328 layers of electrically conductive material. In the present example, the porous member 324 comprises porous quartz, the first layer 326 comprises tungsten and the second layer 328 comprises gold. The thickness of the porous member 324 is approximately 2.5 mm. The thickness of the first layer 326 of tungsten is approximately 1200 nm and the thickness of the second layer 328 of silver is approximately 15 nm. The first layer 326 has been directly deposited on the porous member 324 by physical vapour deposition (PVD) and second layer 328 was then deposited on the first layer 326, also by PVD. The aforementioned thickness for the first 326 and second 328 layers provide sufficient electrical conductivity for the fluid permeable heater 322 without filling or blocking the pores of the porous member 324 such that the porous outer surface upon which the heater is deposited remains porous. The skilled person will appreciate that different combinations of suitable materials and thicknesses can be used, for example, as discussed earlier in this application.

Figure 4:
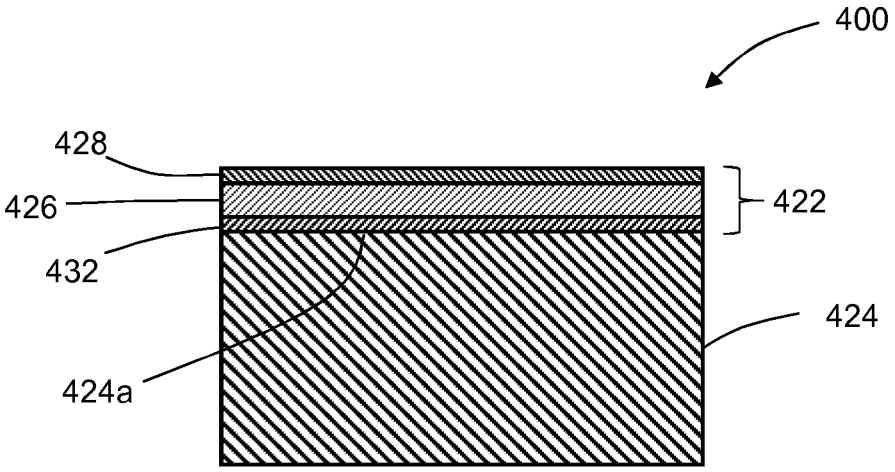
FIG. 4 is a schematic illustration of a cross-section of a heater assembly in accordance with an embodiment of the invention.

FIG. 4 is a schematic illustration of a cross-section of a heater assembly 400 in accordance with a further embodiment of the invention. Again, the drawing is not to scale. The heater assembly is substantially the same as the heater assembly 300 shown in FIG. 3, with the exception that the fluid permeable heater comprises an additional third layer 432. In the following description, like reference numerals have been used to designate those parts in common with the heater assembly 300 shown in FIG. 3.

The heater assembly 400 comprises a porous member 424 and a multi-layer fluid permeable heater 422 deposited on a porous outer surface of a first end 424*a* of the porous member 424. The fluid permeable heater 422 is formed of first layer 326 of tungsten and second layer 328 of silver. The fluid permeable heater further comprises a third layer 432 arranged between porous member 424 and the first layer 426. The third layer 432 is formed of tantalum and is approximately 15 nm thick. A layer of tantalum helps to improve the adhesion of the fluid permeable heater to the porous member 424. The thickness of the third layer 432 is relatively small compared to the overall thickness of the heater and therefore this additional layer can be added without filling or blocking the pores of the porous member 324 such that the porous outer surface upon which the heater is deposited remains porous. The skilled person will appreciate that different combinations of suitable materials and thicknesses can be used, for example, as discussed earlier in this application.

Figure 5:
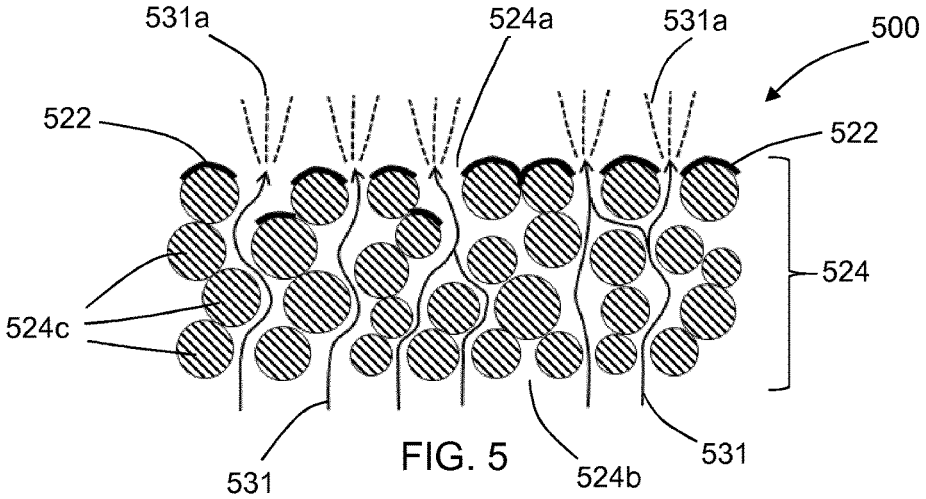
FIG. 5 is a schematic illustration of a magnified cross-section of part of a heater assembly in accordance with an embodiment of the invention showing the permeation of a liquid aerosol-forming substrate through a porous member having a layer of electrically conductive material deposited on the grains or particles of a porous outer surface of the porous member.

FIG. 5 is a schematic illustration of a magnified cross-section of part of a heater assembly 500 in accordance with an embodiment of the invention. The porous member 524 comprises a plurality of grains or particles 524*c* sintered together. The size of the particles and the degree of sintering may determine the porosity and the size of the pores in the porous member 524. For example, if a lower porosity is required, smaller particles with increased sintering can be used and, if a higher porosity is required, larger particles with less sintering can be used. Liquid aerosol-forming substrate 531 is conveyed through the porous member 524 by means of capillary action occurring within the pores of the porous member 524. The liquid aerosol-forming substrate is conveyed from a second end 524*b* of the porous member 524 in contact with a store of liquid aerosol-forming substrate to a first end 524*a* having a fluid permeable heater 522, where it is vaporised, such that vaporised aerosol-forming substrate 531*a* is emitted from the pores in the porous outer surface arranged at the first end 524*a* of the porous member 524.

The fluid permeable heater 522 is deposited on to the porous outer surface by PVD at the first end 524*a* of the porous member 524. The fluid permeable heater 522 comprises multiple layers, although, for simplicity, these are not shown in FIG. 5. The multiple layers comprise a first layer of deposited electrically conductive material and a second layer of deposited electrically conductive material having a higher electrical conductivity than the first layer. The second layer is used modify the electrical resistance of the fluid permeable heater 522 to a required resistance. The fluid permeable heater 522 may also have a third layer (not shown) such as an adhesion layer arranged between the porous member 524 and the first layer for improving the adhesion of the first layer to the porous member.

The fluid permeable heater 522 has partially diffused into the porous outer surface at the first end 524 of the porous member 524, i.e. the fluid permeable heater 522 partially extends into the pores of the porous outer surface. This assists in improving contact between the fluid permeable heater 522 and the porous member 524 and helps increase adhesion between the heater 522 and the porous member 524. The porosity of the porous member 524 and the thickness of the fluid permeable heater 522 can be selected to leave the pores in the porous outer surface at the first end 524 of the porous member 524 open, i.e. so as to not block the pores. FIG. 5 shows pores being open such that liquid aerosol-forming substrate which has permeated through the porous member 514 is vaporised at the fluid permeable heater 522 and is emitted from the open pores in the fluid permeable heater 522 as vaporised aerosol-forming substrate 531*a*.

Figure 6:
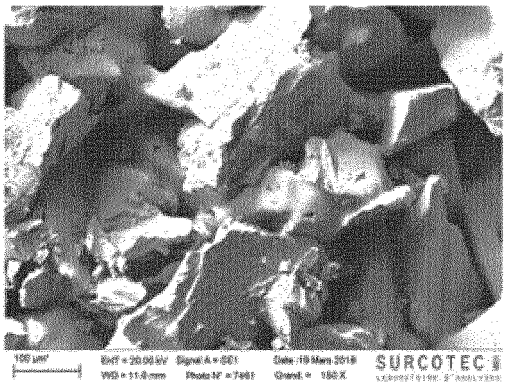
FIG. 6 is an image taken by a scanning electron microscope at 150× magnification showing part of a heater assembly in accordance with an embodiment of the invention comprising a quartz porous member having a layer of tungsten deposited by PVD and prior to the deposition of a second layer.

FIG. 6 is a scanning electron microscope image taken at 150× magnification of part of a heater assembly in accordance with an embodiment of the invention. The heater assembly comprises a quartz porous member having a layer of tungsten deposited as a first layer on the porous member by PVD, which layer having an average thickness of approximately 1200 nm. As can be seen from FIG. 6, the pores in the quartz porous member, i.e. the dark regions between the grains of quartz in FIG. 6, remain open and are not blocked by this thickness of first layer. FIG. 6 shows the heater assembly prior to the deposition of a second layer. However, as discussed above, the thickness of the second layer, i.e. between 10 and 20 nm, is relatively thin compared the thickness of the first layer and therefore its deposition on the first layer is not likely to block the pores.

Figure 7:
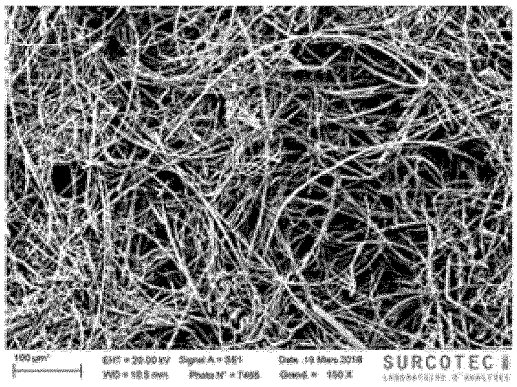
FIG. 7 is an image taken by a scanning electron microscope at 150× magnification showing part of a heater assembly in accordance with an embodiment of the invention comprising a glass fibre porous member having a layer of tungsten deposited by PVD and prior to the deposition of a second layer.

FIG. 7 is a scanning electron microscope image taken at 150× magnification of part of a heater assembly in accordance with an embodiment of the invention. The heater assembly comprises a glass fibre porous member having a layer of tungsten deposited as a first layer on the porous member by PVD, which layer having an average thickness of approximately 500 nm. As can be seen from FIG. 7, the pores in the glass fibre porous member, i.e. the dark regions between the glass fibres in FIG. 7, remain open and are not blocked by this thickness of first layer. FIG. 7 shows the heater assembly prior to the deposition of a second layer. However, as discussed above, the thickness of the second layer, i.e. between 10 and 20 nm, is relatively thin compared the thickness of the first layer and therefore its deposition on the first layer is not likely to block the pores.

The invention claimed is:

1. A heater assembly for an aerosol-generating system, the heater assembly comprising:

a fluid permeable heater for heating a liquid aerosol-forming substrate to form an aerosol;

a porous member for conveying liquid aerosol-forming substrate to the fluid permeable heater, wherein the fluid permeable heater is deposited on to a porous outer surface of the porous member, the fluid permeable heater comprising:

a first layer of deposited electrically conductive material;

a second layer of deposited electrically conductive material, wherein the electrical conductivity of the second layer is greater than the electrical conductivity of the first layer such that the second layer modifies the electrical resistance of the fluid permeable heater to a required resistance.

2. The heater assembly according to claim 1, wherein the first layer is deposited directly on the porous outer surface of the porous member.

3. The heater assembly according to claim 1, wherein the fluid permeable heater further comprises a third layer arranged between the porous outer surface of the porous member and the first layer.

4. The heater assembly according to claim 3, wherein the third layer acts as an adhesion layer to improve the adhesion between the first layer and the porous outer surface of the porous member.

5. The heater assembly according to claim 3, wherein the third layer comprises a material selected from one or more of Tantalum, Titanium and Chromium.

6. The heater assembly according to claim 1, wherein the second layer is deposited on the first layer.

7. The heater assembly according to claim 1, wherein the second layer comprises a material having a resistivity of less than $5\times10^{-8}$ Ωm.

8. The heater assembly according to claim 1, wherein the thickness of the second layer is between 10 and 20 nm.

9. The heater assembly according to claim 3, wherein the thickness of the third layer is between 10 and 20 nm.

10. The heater assembly according to claim 1, wherein the second layer modifies the electrical resistance of the fluid permeable heater to between 0.3 and 4 Ohms, more particularly between 0.5 and 1.5 Ohms and yet more particularly 1 Ohm.

11. A cartridge for use in an aerosol-generating system, the cartridge comprising a liquid storage portion for holding a liquid aerosol-forming substrate; and the heater assembly according to claim 1.

12. The cartridge according to claim 11, wherein the fluid permeable heater is deposited on to a porous first end of the porous member and wherein a second end of the porous member extends into the liquid storage portion for contact with the liquid aerosol-forming substrate therein.

13. An aerosol-generating system comprising:

an aerosol-generating device; and the cartridge according to claim 11, wherein the cartridge is removably coupled to the aerosol-generating device and the aerosol-generating device includes a power supply for the heater assembly.

14. A method of manufacturing a heater assembly for an aerosol-generating system, the method comprising:

providing a porous member;

depositing a fluid permeable heater onto a porous outer surface of the porous member, the fluid permeable heater comprising:

a first layer of deposited electrically conductive material;

a second layer of deposited electrically conductive material;

wherein the electrical conductivity of the second layer is greater than the electrical conductivity of the first layer such that the second layer modifies the electrical resistance of the fluid permeable heater to a required resistance.

15. The method according to claim 14, wherein the first and second layers are deposited by physical vapour deposition (PVD) or plasma-enhanced chemical vapour deposition (PECVD).

* * * * *